US005265785A

United States Patent [19]

Chudy

[11] Patent Number: 5,265,785

[45] Date of Patent: Nov. 30, 1993

[54] PROTECTIVE GLOVE PROVIDER

[76] Inventor: Thomas G. Chudy, P.O. Box 153, Mauston, Wis. 53948

[21] Appl. No.: 871,245

[22] Filed: Apr. 20, 1992

[51] Int. Cl.[5] ..... A45F 5/00; B65D 83/00

[52] U.S. Cl. ..... 224/252; 206/37; 206/278; 224/191

[58] Field of Search ..... 206/37, 38, 278, 438, 206/494, 812, 390; 224/252, 253, 269, 191, 194, 195, 196, 199, 217-222, 224, 226; 221/45, 63, 307, 309, 312 C, 312 R

[56] References Cited

U.S. PATENT DOCUMENTS

| | | | |
|---|---|---|---|
| 2,347,823 | 5/1944 | Goodman et al. | 224/196 |
| 3,735,865 | 5/1973 | Smith | 206/390 |
| 3,982,659 | 9/1976 | Ross | 221/63 |
| 3,994,417 | 11/1976 | Boedecker | 221/63 |
| 4,034,853 | 7/1977 | Smith | 206/494 |
| 4,171,047 | 10/1979 | Doyle et al. | 206/494 |
| 4,180,160 | 12/1979 | Ogawa et al. | 221/63 |
| 4,534,491 | 8/1985 | Norton et al. | 221/63 |
| 4,535,912 | 8/1985 | Bonk | 221/63 |
| 4,708,273 | 11/1987 | Grant | 224/252 |
| 5,044,494 | 9/1991 | Tamura | 206/438 |
| 5,181,537 | 1/1993 | Santilli | 224/252 |

FOREIGN PATENT DOCUMENTS

| | | | |
|---|---|---|---|
| 0381821 | 8/1990 | European Pat. Off. | 221/45 |

*Primary Examiner*—Jimmy G. Foster

*Attorney, Agent, or Firm*—Michael, Best & Friedrich

[57] ABSTRACT

A protective glove provider comprised of removably, lockably, interconnected body and base members which are comprised of semi-rigid materials and are configured to provide a rigid canister which includes an aperture surrounded by flexible material in one end for receiving or dispensing protective garments into and out of the canister.

6 Claims, 1 Drawing Sheet

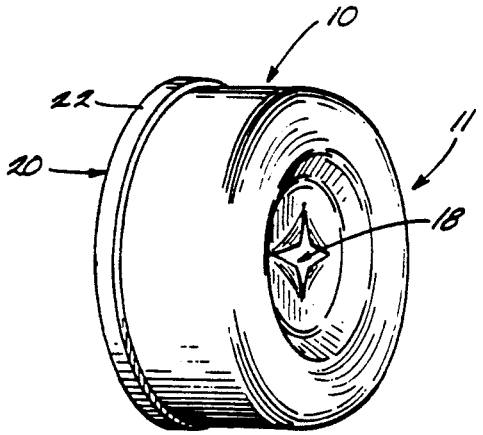
Fig. 1
Fig. 2.
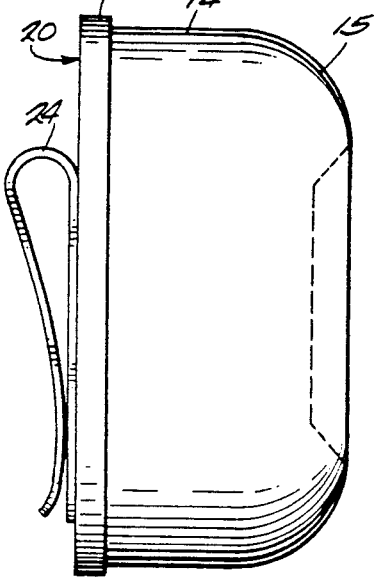
Fig. 3
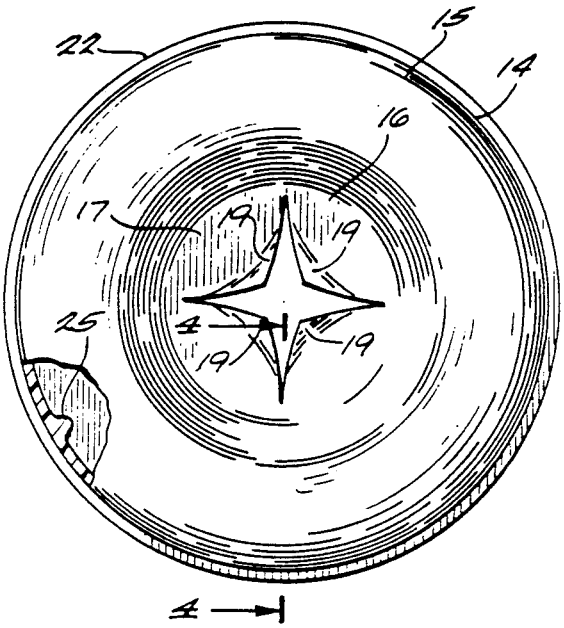
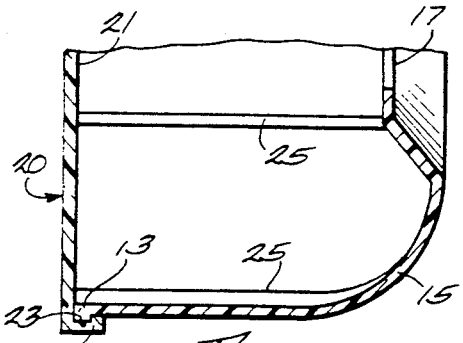
Fig. 4
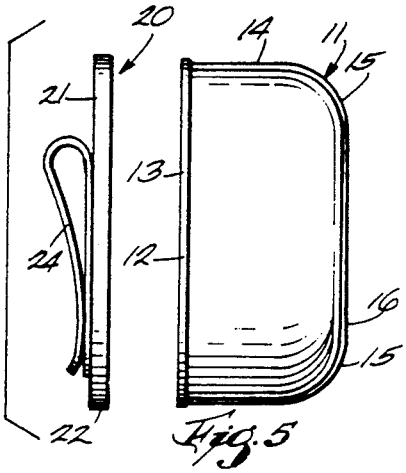
Fig. 5

PROTECTIVE GLOVE PROVIDER

BACKGROUND OF THE INVENTION

1. Field of the Invention

This invention is related to a device for, providing protective gloves at diverse, convenient locations, and more particularly to a rigid container which may be easily disassembled or refilled with gloves for use by members of the public and in particular the health care profession who are commonly exposed to carriers of highly communicable diseases.

2. Description of the Prior Art

In one current contest with communicable diseases, the use of protective garments, such as gloves that are impervious to communicable bacteria or viruses, such as carriers of acquired immune deficiency syndrome (AIDS), has resulted in an increasing need for furnishing the gloves to individuals engaged in diverse activities in and outside of the medical profession.

The need for a system which provides for ready access to such gloves has been set forth in U.S. Pat. No. 4,863,084 issued Sep. 5, 1989 to Dawn M. Nabozny for HIPHOLSTER GLOVES in which a plate, or carrier, that may be attached at a convenient location on the body of an individual working with patients or other individuals who may be afflicted with a communicable disease, is adapted to have a supply of gloves removably attached to the carrier so as to provide ready access to the individual.

While there may be other various and sundry arrangements and configurations of apparatus for furnishing supplies of protective gloves, such as that shown in the Nabozny patent, it has become clear to me that there is a need to provide gloves in a manner that the supply of gloves is protected from environmental effects and will be very easily accessible to individuals who may require the use of protective gloves in various locations and under diverse conditions, for example, police officers, firemen, public health officials and a host of others.

The Nabozny patent describes a number of prior art patents, many of which may be useful in the dispersal of gloves, and none of which provide the novel and unobvious features of my invention as will be described below.

SUMMARY OF THE INVENTION

The present invention provides for a rigid, reusable glove container which may be used under diverse, adverse environmental conditions under circumstances which provide ready access thereto by individuals working with patients, or the like, afflicted with communicable diseases or in connection with the handling of utensils and appliances that may have been used in the treatment or handling of individuals having communicable contagious conditions.

My invention provides a canister that is comprised of two pieces and that is constructed of material which is normally semi-rigid, but when assembled, provides a substantially rigid canister. The canister is suited to contain gloves therein and has a flexible access opening portion or port for dispensing the gloves. A base of the canister may be provided with means for attaching the canister to the clothing of a worker or for permanently or removably attaching the canister to or on a working environmental location such as the roof or dashboard of a vehicle or simply the wall of a room.

My canister is shown comprised of an open-ended cylindrical body portion which contains a radially outwardly extending ridge adjacent the open end and an aperture disposed in the closed end. The closed end is comprised of flexible material while the remainder of the body is comprised of semi-rigid material. A bottom is likewise comprised of semi-rigid material and includes an axially-extending rim portion having a radially inwardly opening interior groove for lockably, removably receiving the ridge adjacent the outer portion of the open end of the body. The outside of the bottom may be provided with a belt clip, suitable VELCRO fasteners, double-sided, adhesive tape or the like.

DESCRIPTION OF THE DRAWINGS

FIG. 1 is a perspective view of the canister used in my system;

FIG. 2 is a side elevational view of the canister of FIG. 1;

FIG. 3 is an end elevational view of my invention;

FIG. 4 is an enlarged fragmentary sectional view taken along section lines 4—4 on FIG. 3; and FIG. 5 is an exploded view of a dissembled canister.

DETAILED DESCRIPTION OF THE PREFERRED EMBODIMENT

Like elements are provided with like reference characters in the several views of the drawings in which a canister 10 is shown comprised of a body member 11 and a cap, or base 20.

Body member 11 is generally cylindrical and has an open end 12, an axially extending peripheral wall of circular cross-section 14, and an end wall 16 (FIG. 3) that is dependent from peripheral wall 14 through a rounded portion 15 which extends radially inwardly and terminates at end wall 16. End wall 16 has a center portion 17 which is open to permit ingress and egress of gloves into and out from the interior of canister 10 which includes an aperture 18 that is defined by spokes of a suitable flexible material. Body 11 is further provided with a peripheral radially outwardly extending ridge 13 adjacent its open end and a plurality of reinforcing, or material stiffening ribs extending axially and radially inwardly of peripheral wall 14. Peripheral walls 14 and 15 are comprised of relatively thick material that is semi-rigid as a result of the selection of suitable plastic material, or the like. End wall 16 is configured of a similar material only is of a lesser thickness so that the flexibility that is exhibited is considerably greater than the flexibility of peripheral walls 14 and 15.

Cap 20 has a flat center portion 21, an axially extending peripheral wall 22 and an inwardly opening, peripherally extended groove 23 which is dimensioned and configured to lockably and removably mate with ridge 13 in body 11. Cap 20 is comprised of a similar plastic material as body 11 and of generally similar thickness so as to provide a semi-rigid flexural characteristic.

As may become apparent from further consideration of the elements of my invention, assembly of cap 20 onto the open end 12 of body 11 results in a substantially rigid, closed container which is comprised at one side of an end wall 16 that is comparatively flexible and that includes an opening 18. The opening 18 is defined by a plurality of inwardly extending spokes which serve to permit the introduction of protective gloves or garments into the interior of canister 10 and to permit their easy withdrawal when the garments are needed.

The canister 10 is appropriately sized to provide a readily available supply of protective garments, such as gloves, for the safety and convenience of personnel who may be working with other afflicted persons.

As shown in the drawings, a clip 24 may be attached to the side of cap 20 so that the assembled and filled canister 10 may be clipped to the belt or other articles of clothing worn by treatment personnel. Under other circumstances, the use of VELCRO double-sided adhesive tape is contemplated to retain the container in a location that is easily seen and readily accessible so that the use of protective garments is encouraged by the user through an improved awareness.

It may now be appreciated that the cooperative combination of the two-part structure of my canister 10 provides an easily useable container for protective garments. The canister 10 is less likely to become damaged or distorted, because of its rigid configuration when assembled, in actual use and, therefore, will remain readily visible and accessible to a user even though it may not be attached to a stationary object or to a garment worn by the user.

It may now be appreciated that my invention provides a facile container which will encourage the use of protective gloves carried inside so that the treatment giver may be protected at all times while presenting the protective garments in a secure and readily accessible status.

I claim:

1. A portable canister apparatus for transporting and dispensing protective gloves, said canister apparatus comprising a canister adapted to contain protective gloves, said canister including a body member, said body member including an open end portion and a closed end portion, said closed end portion including an end wall having an aperture, said end wall having a thickness less than the thicknesses of the remainder of said body member so that said end wall is flexible relative to the remainder of said body member to permit withdrawal of the protective gloves from said canister through said aperture, and said canister including a base member attachable to said body member to close said open end portion of said body member, each of said body member and said base member being made of a semi-rigid plastic material such that when said base member is attached to said body member to form said canister, said canister is substantially rigid, and means on said canister for attaching said canister to a person.

2. A portable canister apparatus as set forth in claim 1 wherein said means for attaching said canister to a person includes a resilient clip member extending from said base member, said clip member being adapted to clip over the person's belt.

3. A portable canister apparatus as set forth in claim 2 wherein said clip member is integral with said base member.

4. A portable canister apparatus as set forth in claim 1 wherein said canister includes means for releasably interconnecting said body member and said base member, said means for releasably interconnecting including a radially outwardly extending ridge on one of said body member and said base member and a cooperating radially inwardly opening groove on the other of said body member and said base member.

5. A portable canister apparatus as set forth in claim 4 wherein said ridge extends radially outwardly from the periphery of said open end portion of said body member, and wherein said base member includes an axially extending peripheral wall portion defining said radially inwardly opening groove.

6. A portable canister apparatus for transporting and dispensing protective gloves, said canister apparatus comprising a cylindrical body member made of a semi-rigid plastic material, said body member including an open end portion and a closed end portion, said closed end portion including an end wall having an aperture, said end wall having a thickness less than the thickness of the remainder of the body member so that said end wall is relatively more flexible than the remainder of said body member to permit removal of protective gloves from said canister apparatus, a circular base member made of a semi-rigid material, said base member being axially shorter than said body member, means for releasably interconnecting said body member and said base member to close said open end portion, said means for releasably interconnecting including an axially extending peripheral wall portion on said base member, said peripheral wall portion defining a radially inwardly opening groove, and a ridge extending radially outwardly from the periphery of said open end portion of said body member and being received in said groove, said body member and said base member, when interconnected, forming a substantially rigid canister adapted to contain the protective gloves, and means for attaching said canister to a person, said means for attaching including a resilient clip member extending from said base member, said clip member being adapted to clip over the person's belt.

* * * * *